US005366283A

United States Patent [19]

Crose

[11] Patent Number: 5,366,283

[45] Date of Patent: Nov. 22, 1994

[54] FILE FOLLOWER LOCKING ASSEMBLY

[75] Inventor: Jeffrey J. Crose, Illinois City, Ill.

[73] Assignee: Hon Industries Inc., Muscatine, Iowa

[21] Appl. No.: 988,995

[22] Filed: Dec. 31, 1992

[51] Int. Cl.[5] ..... A47B 63/00

[52] U.S. Cl. ..... 312/183; 220/548

[58] Field of Search ..... 312/193, 183, 187, 190; 220/532, 544, 548; 211/46

[56] References Cited

U.S. PATENT DOCUMENTS

| | | | |
|---|---|---|---|
| 860,223 | 7/1907 | Marshall . | |
| 1,032,491 | 7/1912 | Millice . | |
| 1,036,515 | 8/1912 | Ohnstrand . | |
| 1,659,620 | 2/1928 | Vignos . | |
| 2,139,283 | 12/1938 | Regenhardt . | |
| 2,166,026 | 7/1939 | Strayer . | |
| 2,303,275 | 11/1942 | Hull . | |
| 2,364,278 | 12/1944 | Drebes . | |
| 2,557,915 | 6/1951 | Regenhardt . | |
| 2,607,352 | 8/1952 | Dunlap . | |
| 2,689,573 | 9/1954 | Foehrenbach . | |
| 2,690,183 | 9/1954 | Behrens . | |
| 3,109,432 | 11/1963 | Regenhardt . | |
| 3,814,490 | 6/1974 | Dean et al. | 312/183 |
| 4,067,630 | 1/1978 | Stark et al. . | |
| 4,782,960 | 11/1988 | Mavrakis . | |
| 4,881,653 | 11/1989 | Norton . | |

FOREIGN PATENT DOCUMENTS

| | | | |
|---|---|---|---|
| 1940731 | 2/1971 | Germany | 312/183 |

*Primary Examiner*—Kenneth J. Dorner
*Assistant Examiner*—Gerald A. Anderson
*Attorney, Agent, or Firm*—Jones, Day, Reavis & Pogue

[57] ABSTRACT

A file follower locking assembly selectively locks and releases a follower plate behind the files in a drawer by using two opposed follower guides with eccentric cam grippers to engage upper and lower surfaces of open wall channels formed in the drawer sides. In a first mode of operation, the cam grippers provide a firm gripping engagement with the upper and lower surfaces. The grippers are released for sliding movement of the assembly along the drawer in a second mode of operation.

17 Claims, 3 Drawing Sheets

FILE FOLLOWER LOCKING ASSEMBLY

FIELD OF THE INVENTION

This invention relates generally to assemblies and components used to support the contents of a drawer, as in a desk or other office furniture cabinet, and more particularly to a file follower locking assembly which use a cam action gripping arrangement for releasably locking a file follower at a desired location. The invention provides a simple, but effective manner of securing files in place while at the same time permitting ready adjustment of the depth of the drawer opening in use.

BACKGROUND OF THE INVENTION

The use of file follower arrangements in one or more drawers of furniture components in an office environment provides convenient support of various papers, files, and other contents of the drawer. Typically, a follower plate or compressor is held in place transverse the drawer opening in abutting engagement with the contents of the drawer. The follower plate in these arrangements is typically adjustable in a longitudinal direction along the drawer opening to permit the number of files in the various classifications to be varied, while maintaining the remaining files in desired upright positions. This permits more efficient use of the cabinet space.

Numerous file follower arrangements have been previously proposed in the art. However, the installation and maintenance requirements of these arrangements have posed practical difficulties. Principle among these difficulties is the complexity of the locking mechanisms utilized so that the follower may be releasably retained at the desired location within the drawer opening. For example, various file follower locking arrangements have been proposed which utilize a locking bar extending the width-wise dimension of the drawer proximate to the file follower. The locking bar is moved to actuate or deactuate locking mechanisms disposed in the sides of the drawer. While these arrangements work adequately for their intended purpose, they are typically unattractive and awkward, requiring an inordinate amount of interactive mechanical parts. They are therefore susceptible to breakdown or failure over extended periods of time.

Other attempts have been made in this field which utilize multiple locking piece assemblies wherein multiple camming or locking pieces are disposed in the side channels of a file drawer for locking or unlocking the file follower. As with the locking bar arrangements, however, these types of locking assemblies also suffer from the afore-noted problems.

Still other approaches for other applications, such as for card trays, have utilized disc-like cams to lock card tray followers and thereby retain quantities of cards in place. One example of this approach is disclosed in U.S. Pat. No. 3,109,432. This arrangement, however, fails to address the problems of retaining files within a drawer space.

SUMMARY OF THE INVENTION

Accordingly, it is an object of the present invention to provide improved file organization in a furniture unit. More specifically, it is an object of the present invention to provide a novel mode for releasably interlocking a file follower within a drawer opening of an office furniture component.

It is another object of the invention to provide a file follower assembly useful in an office furniture component which is quite simple in construction while at the same time effectively interlocking a file follower in operation.

It is still another object of the present invention to provide a file follower locking assembly that may be easily actuated or deactuated, yet which provides a high degree of durability and reliability.

These and other additional objects are accomplished in a file follower locking assembly particularly useful in a drawer of a desk or in another furniture component in an office environment. The file follower locking assembly of the present invention selectively locks and releases a follower plate behind the files in a drawer by using eccentric cam grippers disposed within open wall channels in the drawer sides. Structurally, a file follower locking assembly comprises a follower plate and two opposed follower guides disposed at the lateral edges of the follower plate. Each follower guide includes a support or cam portion projecting into a respective open wall channel on the side of the drawer. Each support portion is formed with an elliptical groove configuration having an apex region and a nadir region. These regions are located along a major transverse axis of the elliptical shape, substantially parallel to the plane of the follower plate. The elliptical groove is sized to receive an O-ring gripper member that protrudes outwardly from the support portion to provide firm gripping engagement with upper and lower surfaces of the open wall channel when the follower plate is oriented in an upright position in a locked mode. The gripper member is shifted to a lesser vertical diameter exposure to effect release of the O-ring gripper from the upper and lower surfaces of the open wall channel for sliding movement when the assembly is rotated to an unlocked mode.

In the preferred embodiment, each of the follower guides includes a control pin spaced from the support portion that also projects into the wall channel to provide a limit stop. This prevents undue rotation of the assembly through the locked or beyond the unlocked position. In this way, the follower is locked by a tilting cam action arrangement for grip locking the follower in a fixed position longitudinally of the drawer when the follower plate is vertical, and which releases for easy sliding movement of the assembly along the drawer when the follower plate is tilted to the unlocked position.

DETAILED DESCRIPTION OF THE DRAWINGS

The following detailed description will permit a more complete understanding of this invention. However, the embodiments described below are simply examples of the invention and the invention is not limited to these embodiments. Furthermore, the drawings are not necessarily to scale. In certain instances, details have been omitted which are not necessary for an understanding of the invention. Generally, the present invention relates to a file follower locking assembly that selectively locks and releases a follower plate behind the files in a drawer by using opposed follower guides having an eccentric cam grippers for engaging upper and lower surfaces of open wall channels formed in the drawer sides. The file follower assembly is intended to be used in the drawers of desk units or other office furniture components where the contents of the drawer are frequently changed or reconfigured.

Figure 1:
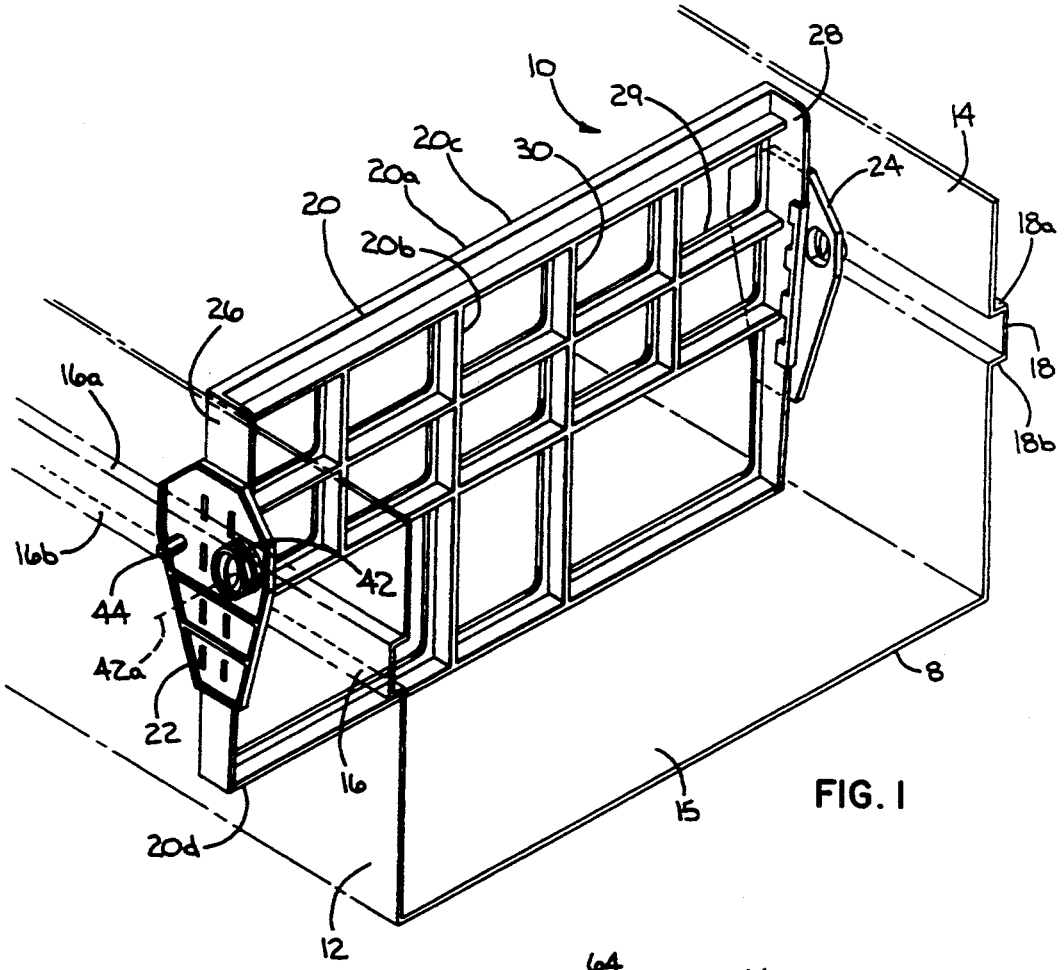
FIG. 1 is an isometric view of a file follower assembly according to the present invention.
Figure 6:
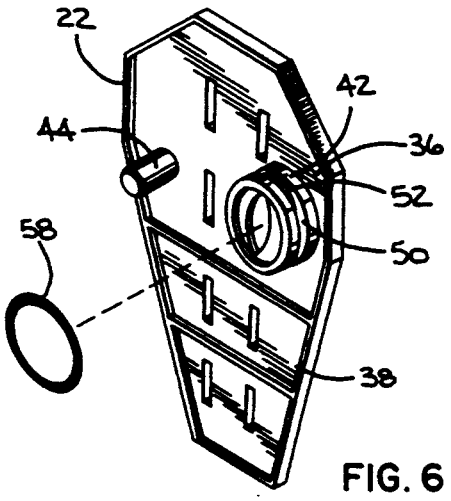
FIGS. 6 and 7 are exploded views of the follower plate and O-ring gripper according to the present invention.
Figure 7:
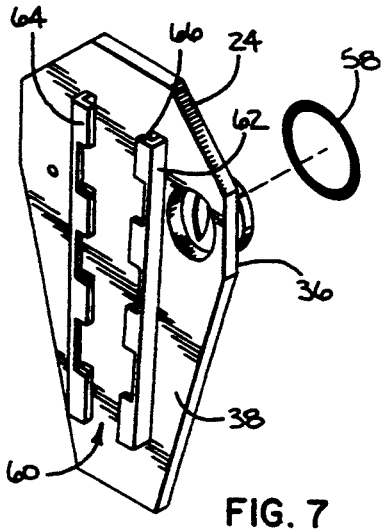

Turning now to the drawings, FIG. 1 illustrates an isometric view of a drawer 8 of a desk unit (not shown) using a file follower locking assembly 10 of the present invention, looking generally from the rear toward the front (user's access end) of the drawer. While a preferred embodiment of the locking assembly is described hereinafter in conjunction with a desk drawer, it should be understood that this assembly can also be incorporated into other cabinet spaces with appropriate modification. The desk drawer 8 provides a drawer space defined by first and second lateral side panels 12 and 14, a bottom panel 15 and front and rear panels (not shown). In FIG. 1, the rear panel would be nearer the viewer and the front panel would be beyond the planer of the page. The side panels 12 and 14 are each provided with U-shaped channels or rails 16 and 18 extending longitudinally along the respective side panels of the drawer 8 and open to the interior of the drawer. The channels 16 and 18 are each defined by substantially parallel upper and lower guide surfaces 16*a*, 16*b* and 18*a*, 18*b*, respectively, defined by the leg portions of the U. As described in greater detail below, a cam gripping arrangement according to the present invention engages the upper and lower guide surfaces 16*a*, 16*b* and 18*a*, 18*b*, respectively, in a locked mode to firmly retain the file follower locking assembly in place. In an unlocked mode, the locking assembly 10 can be readily moved forwardly and rearwardly within the drawer space.

Figure 2:
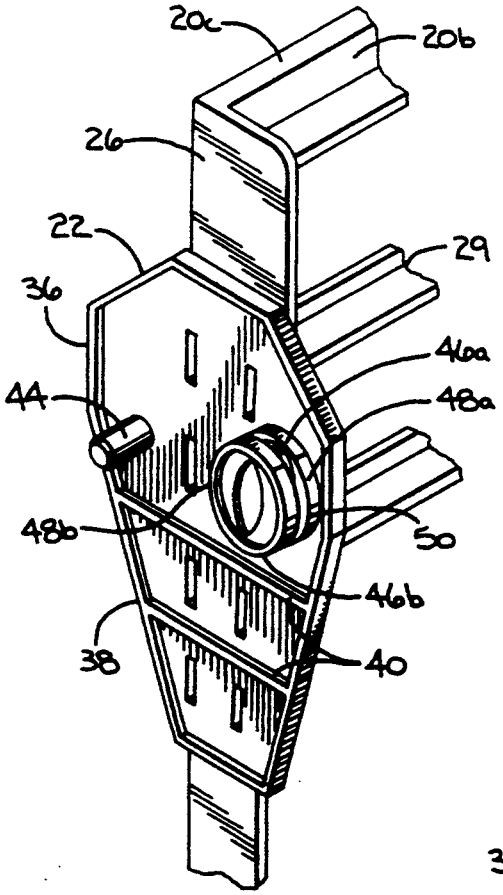
FIG. 2 is an isometric view of a follower guide and follower plate included in the assembly shown in FIG. 1.
Figure 3:
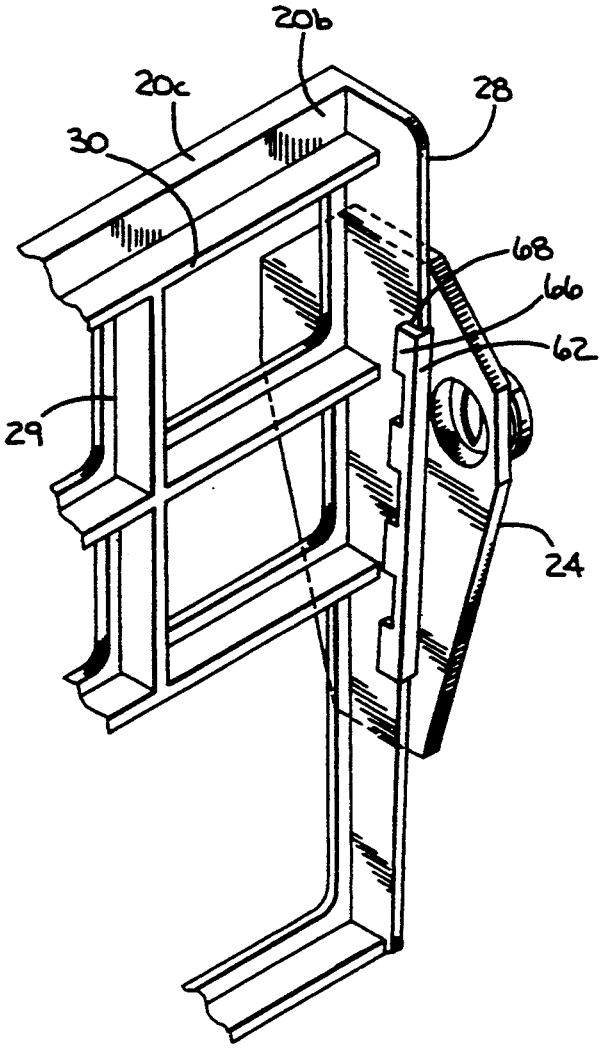
FIG. 3 is an isometric view of the file follower assembly of FIG. 1, looking toward the other side, illustrating connection between a follower guide and follower plate in greater detail.

FIG. 1, and also FIGS. 2–3, illustrate the details of the locking assembly 10. The present invention, in its preferred embodiment, contemplates a file follower plate 20 and a complementary pair of opposed follower guides 22 and 24. The follower plate 20 is preferably of molded plastic generally planar frame construction and includes forwardly and rearwardly facing surfaces 20*a* and 20*b*, lower and upper edges 20*c* and 20*d*, and side edges 26 and 28. The side edge ribs 26 and 28 are adjacent but spaced inwardly from the drawer sides 12 and 14 such that the follower plate 20 extends substantially across the transverse dimension of the drawer space. The follower plate of the preferred embodiment is shown in a grill or lattice configuration comprised of vertically and transversely extending ribs 29. It should be understood, however, that the follower plate 20 could be any other configuration including a solid sheet so long as the structural integrity of the follower plate is sufficient to support the materials of the drawer. In the preferred embodiment, the forwardly facing side surface 20*a* of the follower plate 20 is relatively flat which will engage the files to be secured by the follower assembly. The rearwardly facing side surface 20*b* provides exposed portions 30 for ready finger engagement and manipulation of the follower plate 20 to effect rotation of the locking assembly, as described below.

FIG. 1 further illustrates the complementary pair of opposed follower guide pieces 22 and 24 attached to the lateral edges 26 and 28, respectively, of the follower plate 20. The opposed follower guides 22 and 24 are mirror images of each other. Accordingly, to facilitate description of the invention, the left hand follower guide 22 will be described with reference to FIGS. 2 and 4–5 and the right hand guide 24 will be described with reference to FIG. 3, where like elements will be employed with like numerals. As described below, the opposed follower guides 22 and 24 each include a cam gripping arrangement to permit rotation from a first inoperative or locked mode to a second operative mode to permit sliding of the file follower locking assembly within the rails 16 and 18 respectively.

Figure 4:
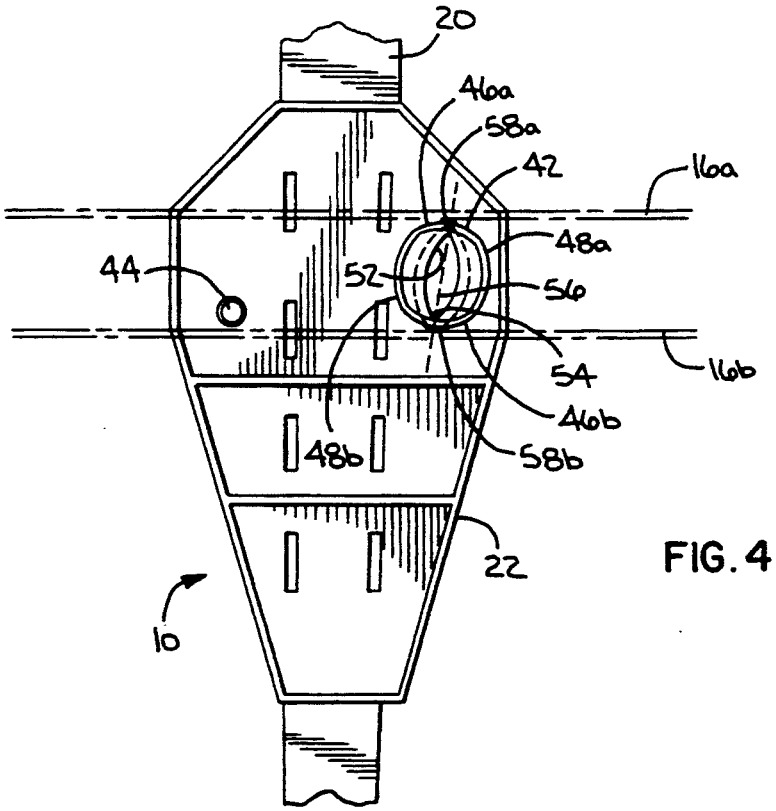
FIG. 4 is a side elevation view of the follower guide and follower plate of FIGS. 1–2 in a first or locked mode of operation.
Figure 5:
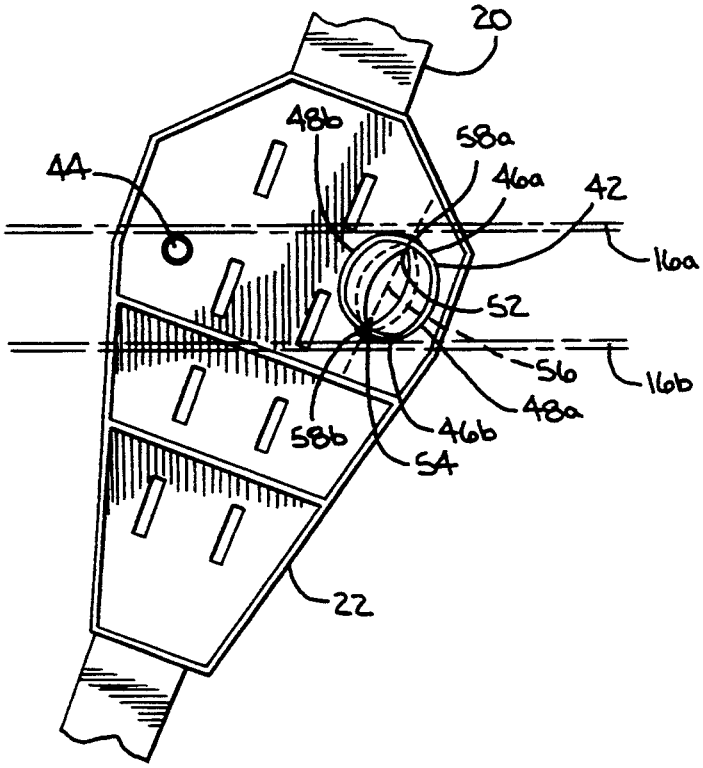
FIG. 5 is a side elevational view of the follower guide and follower plate of FIGS. 1–2 in a second or unlocked mode of operation enabling ready movement of the follower guide.

The main structural details of the left hand follower guide 22, as viewed from FIG. 1 are best seen in FIGS. 2 and 4–5. As illustrated therein, the follower guide 22 is an irregular octagonal piece fabricated of plastic by injection molding in the preferred embodiment. The follower guide 22 has an enlarged body portion 36 and a leg portion 38 depending therefrom. It preferably includes structural ribs 40 extending along the leg portion 38.

FIGS. 2 through 5 also show a follower guide support stud or cam portion 42 projecting outwardly from the body portion 36. The follower guide support 42 has a generally elliptical outer periphery, which includes upper and lower peripheral segments 46*a* and 46*b* and a pair of side peripheral segments 48*a* and 48*b*. As best seen in FIGS. 4 and 5, support 42 extends into the respective channel 16 such that the support substantially occupies the channel space between the upper and lower guide surfaces 16*a* and 16*b*. Likewise, the support 42 is of sufficient thickness to support the follower assembly within the channel 16. The upper and lower peripheral segments 46*a* and 46*b* have a tapered outer periphery in relation to the side peripheral segments 48*a* and 48*b* such that the distance between the outermost peripheral segments 46*a* and 46*b* is less than the distance between the upper and lower guide surfaces 16*a* and 16*b*. Thus, the support portion 42 may be rotated within the side channel 16 to thereby rotate the locking assembly about an axis of rotation 42*a* without engagement of the upper and lower peripheral segments with the channel guide surfaces.

An annular groove 50 is formed in the follower guide support portion 42 having an elliptical configuration that defines an apex region 52 and a nadir region 54 along the major axis 56 of the ellipse. The annular groove 50 is sized to receive an O-ring gripping member 58 which engages the upper and lower guide surfaces 16*a* and 16*b*, as described below. The O-ring gripping member 50 is preferably fabricated of rubber or other material which provides suitable resiliency and friction characteristics for firm gripping action when in firm contacting relation with the guide surfaces 16*a* and 16*b*. As seen in FIGS. 4–5, the O-ring gripping member 58 protrudes from the outer periphery of the upper and lower segments 46*a* and 46*b* to provide upper and lower engagement surfaces 58*a* and 58*b*. The distance between the upper and lower engagement surfaces 52 and 54 exceeds the distance between the upper and lower guide surfaces 16*a* and 16*b*.

FIGS. 2 and 4–5 also illustrate a control pin or stud 44 spaced from the follower guide support 42. As best seen in FIGS. 4 and 5 the control pin 44 also projects into the side channel 16 of the drawer 8. The control pin 44 has an axis 45 that is offset a selected distance from the follower guide cam axis 42*a*. Thus, when the assembly is rotated about the follower guide cam axis 42*a*, the control pin 44 abuts the upper or lower guide surface to prevent undue rotation of the file follower locking assembly both beyond a locked position, which is generally vertical, and beyond a predetermined tilted unlocked position.

FIG. 3 is an isometric view of the opposed follower guide 34 illustrating connection to the follower plate 20. The side of the follower guide opposite the follower guide cam element 42 includes a channel 60 defined by opposed L-shaped rails 62 and 64 (see FIG. 8). The rails include spaced nubs 66 extending inwardly which form flanges to engage the follower plate edge rib 28. The follower plate 20 is slideably engaged within the channel 60 and preferably includes a shoulder 68 to limit mating engagement travel of the follower plate 20 into the follower guide 24. Likewise, follower guide 22 is located on the opposed side edge 26 in exactly the same manner.

The operation of the follower guide assembly 10 is best seen with reference to FIGS. 4 and 5. As shown in FIG. 4, the follower plate 20 and guide 32 assume a substantially vertical position when in a first or locked mode. In this mode, the follower guide support 42 is rotated about cam axis 42*a* such that the upper and lower engagement surfaces 52 and 54 of the O-ring gripper 50 engage the upper and lower guide surfaces 16*a* and 16*b* in firm compressive wedging friction engagement to interlock the assembly and thereby prevent movement of the follower longitudinally of the drawer. The control pin 44 prevents undue rotation of the assembly 10 in the locked mode.

The contents of the drawer apply force against the forwardly facing side surface 20*a* of follower plate 20 generally below the cam axis 42*a* in a direction toward the rear of the drawer 8. Accordingly, such forces tend to retain the follower guide assembly 10 in the locked mode and the O-ring gripper 50 in friction engagement with the upper and lower guide surfaces 16*a* and 16*b*. The opposed follower guide 24 operates in exactly the same manner.

FIG. 5 illustrates the follower plate 20 and follower plate guide 32 rotated about cam axis 42*a* to an unlocked or second mode. In this mode, a force is applied against the forwardly facing side surface 20*a* of follower plate 20 generally above the cam axis 42*a* in a direction toward the rear of the drawer 8 such that the upper and lower engagement surfaces 52 and 54 are disengaged from the upper and lower guide surface 16*a* and 16*b*. Likewise, the control pin 44 engages the upper guide surface 16*a* to prevent over rotation of the assembly. In this mode, the follower guide assembly 10 may be readily moved longitudinally within the drawer space.

The upper edge of the top rib of the follower plate 20 also may serve as a support for one end of file hangers, the other end of which may be supported by other structure.

In the preferred embodiment as illustrated, each of the guides 22, 24 and the follower plate 20 is a single molding. The support stud portions 42 and stud pins 44 are unitary with the body portion of each guide, as are the respective mounting rails 62 and 64. Further, the follower plate and the guide may be assembled simply by slide mating of the side ribs into the respective rails of the guides. Addition of the O-rings completes the assembly. While the use of O-rings presently is preferred, it will be appreciated that by selection of appropriate materials and configurations of the support portions, other friction pads or surfaces may be used.

Various advantages flow readily from the above described file follower locking design. For example, the locking assembly represents a substantial cost savings, using relatively few mechanical parts. In addition, the locking assembly is relatively simple to fabricate and install, while being reliable in operation.

As set forth above, an file follower locking assembly has been described. Various modifications as would be apparent to one of ordinary skilled in the art and familiar with the teaching of this application are deemed to be within the scope of this invention. Accordingly, the precise scope of the invention is set forth in the appended claims, which are made, by reference, a part of this disclosure.

What is claimed is:

1. A file follower locking assembly for use in a cabinet drawer with opposed sides defining a longitudinal drawer space, comprising, in combination:

a side channel extending at an intermediate height along each of said sides in communication with said drawer space and each side channel including parallel upper and lower inner surfaces;

a follower plate for substantially spanning said drawer between said opposed sides for supporting materials in said drawer;

a first follower guide coupled with said follower plate and including a support element for projecting into one of said channels of the drawer, said support element being of a configuration and size to permit sliding movement thereof along said one of said channels to permit tilting of said follower plate and guide between first and second angular positions about a lateral axis, and gripper means mounted on said support element and disposed to present opposed external peripheral engagement surface portions spaced from one another by a first distance which exceeds the spacing between said upper and lower inner surfaces of said channel, said opposed peripheral engagement surface portions being positioned on said support element for locking engagement with said upper and lower inner surfaces of said channel in said first angular position to retain said follower in a fixed position in said drawer and to be free of said inner surfaces to permit sliding of said follower plate and locking assembly along said drawer in said second angular position.

2. The invention as in claim 1 including a gripping member circumscribing said support element, portions of said gripping member comprising said gripper means.

3. The invention as in claim 1 wherein said support element is of a non-circular section and includes a gripping member circumscribing said support element, portions of said gripping member comprising said gripper means.

4. The invention as in claim 1 wherein said support element is of a non-circular cross section having a major transverse axis, and including a gripping member circumscribing said support element, portions of said gripping member traversing said major axis comprising said gripper means.

5. The invention as in claim 1 wherein said support element is a generally cylindrical stud formed with an annular groove providing an oval cross-section, and an O-ring disposed in said groove with portions at the ends of the oval comprising said gripper means.

6. The invention as in claim 1 wherein said first follower guide includes a second support element spaced from the aforementioned support element for also projecting into said one of said channels for limiting the tilting movement of said follower guide and the follower plate coupled thereto.

7. The invention as in claim 1 and including a second follower guide corresponding to said first follower guide, said follower guides being coupled to opposite sides of said follower plate and whereby the respective support element on each guide will project into the channels in the respective adjacent sides of said drawer.

8. The invention as in claim 1 wherein said follower plate includes an end rib and said follower guide defines a channel having sliding mating engagement with said rib for coupling said follower guide to said follower plate.

9. The invention as in claim 8 wherein said follower guide includes a body portion and opposed flange sections extending from said body portion and defining said channel therewith for engaging said ribs.

10. The invention as in claim 9 wherein each of said follower guides is formed of molded plastic.

11. A file follower locking assembly for use in a cabinet drawer with opposed sides defining a longitudinal drawer space, comprising in combination:

a side channel extending at an intermediate height along each of said sides in communication with said drawer space and each side channel including parallel upper and lower inner surfaces;

a follower plate for substantially spanning said drawer between said opposed sides for supporting materials in said drawer, said follower plate including a rib along each side thereof;

a pair of follower guides each defining a channel for sliding mating engagement with one of said ribs to join each of said pair of guides to said plate and including a support element for projecting into one of said side channels of the drawer, said support element being of a configuration and size to permit sliding movement thereof along said respective side channel.

12. The invention as in claim 11 wherein said support element is of a configuration to permit tilting of said follower plate and guide between first and second angular positions about a lateral axis, and gripper means mounted on said support element and disposed to present opposed external peripheral engagement surface portions spaced from one another by a first distance which exceeds the spacing between said upper and lower surfaces, said opposed peripheral engagement surface portions being positioned on said support element for locking engagement with said upper and lower inner surfaces of the respective side channel of said drawer in said first angular position to retain said follower in a fixed position in said drawer and to be free of said surfaces to permit sliding of said follower plate and locking assembly along said drawer in said second angular position.

13. The invention as in claim 12 wherein said support element further has opposed peripheral portions immediately adjacent said gripper means and offset therefrom in the same angular direction along the periphery of said support element, said further opposed peripheral portions being spaced from one another by a second distance which is less than said spacing between said upper and lower inner surfaces of said side channels of said drawer.

14. The invention as in claim 13 wherein said follower plate and said pair of follower guides are tiltable about a lateral axis which extends through each said support element.

15. The invention as in claim 14 wherein said file follower locking assembly is mounted in a drawer in an orientation such that forces applied against said follower plate below each said support element and in a direction toward the rear of said drawer tend to tilt said follower plate and guides coupled thereto from said second angular position toward said first angular position for locking said assembly against sliding movement, and forces applied to the top of said follower plate in a direction toward the rear of said drawer tend to tilt said follower from said first angular position toward said second angular position to permit sliding movement of said assembly along said drawer.

16. A file follower locking assembly for use in a cabinet drawer with opposed sides defining a longitudinal drawer space, comprising in combination:

a side channel extending at an intermediate height along each of said sides in communication with said drawer space and each side channel including parallel upper and lower inner surfaces;

a follower plate for substantially spanning said drawer between said opposed sides for supporting materials in said drawer;

a first follower guide coupled with said follower plate and including a support element for projecting into one of said channels of the drawer, said support element being a generally cylindrical stud formed with an annular groove providing an oval cross-section, and an O-ring disposed in said groove, said support element permits tilting of said follower plate and guide between first and second angular positions about a lateral axis; and opposed external peripheral engagement surface portions at the ends of the oval spaced from one another by a first distance which exceeds the spacing between said upper and lower inner surfaces, said opposed peripheral engagement surface portions being positioned on said support element for locking engagement with said upper and lower inner surfaces in said first angular position to retain said follower in a fixed position in said drawer and to be free of said inner surfaces to permit sliding of said follower plate and locking assembly along said drawer in said second angular position.

17. A cabinet drawer with opposed sides defining a longitudinal drawer space, including in combination:

a side channel extending at an intermediate height along each of said sides in communication with said drawer space and each side channel including parallel upper and lower inner surfaces;

a follower plate for substantially spanning said drawer between said opposed sides for supporting materials in said drawer;

a first follower guide coupled with said follower plate and including a support element for projecting into one of said channels of the drawer, said support element being of a configuration and size to permit sliding movement thereof along said one of said channels to permit tilting of said follower plate and guide between first and second angular positions about a lateral axis, and gripper means mounted on said support element and disposed to present opposed external peripheral engagement surface portions spaced from one another by a first distance which exceeds the spacing between said upper and lower inner surfaces, said opposed peripheral engagement surface portions being positioned on said support element for locking engagement with said upper and lower inner surfaces in said first angular position to retain said follower in a fixed position in said drawer and to be free of said inner surfaces to permit sliding of said follower plate and guide along said drawer in said second angular position.

* * * * *